US005367730A

United States Patent [19]

Sher

[11] Patent Number: 5,367,730

[45] Date of Patent: Nov. 29, 1994

[54] INFANT CUSHION

[76] Inventor: Stephen Sher, 1399 Kennedy Road, Unit 22, Toronto, Ontario, M1P 2L6, Canada

[21] Appl. No.: 131,186

[22] Filed: Oct. 4, 1993

Related U.S. Application Data

[63] Continuation of Ser. No. 2,596, Dec. 17, 1992, Pat. No. Des. 343,756.

[30] Foreign Application Priority Data

Oct. 15, 1992 [CA] Canada ..... 1510926

[51] Int. Cl.[5] ..... A47D 13/08; A47D 15/00; A47G 9/00

[52] U.S. Cl. ..... 5/655; 5/632; 5/922

[58] Field of Search ..... 5/655, 424, 425, 922, 5/630, 632, 638, 603

[56] References Cited

U.S. PATENT DOCUMENTS

| | | | |
|---|---|---|---|
| 3,124,812 | 3/1964 | Milton et al. | 5/636 |
| 3,951,453 | 4/1976 | Zapf | 297/440 |
| 4,571,757 | 2/1986 | Zolecki | 5/628 |
| 4,607,402 | 8/1986 | Pollard | 5/425 |
| 5,056,533 | 10/1991 | Solano | 5/655 |
| 5,154,477 | 10/1992 | Lacy | 297/DIG. 6 |
| 5,165,130 | 11/1992 | Wendling | 5/655 |
| 5,193,238 | 3/1993 | Clute | 5/655 |
| 5,216,772 | 6/1993 | Clute | 5/655 |
| 5,272,780 | 12/1993 | Clute | 5/655 |

FOREIGN PATENT DOCUMENTS

| | | | |
|---|---|---|---|
| 926168 | 2/1970 | Switzerland | 297/231 |
| 9116842 | 11/1991 | WIPO | 5/655 |

*Primary Examiner*—Alexander Grosz
*Attorney, Agent, or Firm*—Arne I. Fors

[57] ABSTRACT

A restrainer device for infants for maintaining an infant generally stationary to prevent the infant from rolling while sleeping comprising a planar surface and two support cushions arranged in a spaced-apart relationship to each other on the planar surface. The planar surface preferably is a sheet or panel of fabric and at least one of the support cushions are releasably attached to the planar surface.

7 Claims, 4 Drawing Sheets

INFANT CUSHION

FIELD OF INVENTION

This is a continuation of U.S. application Ser. No. 29/002,596 filed Dec. 17, 1992 now U.S. Pat. Des. No. 343,756.

This invention relates to a restrainer device for infants, and more particularly, relates to a pair of support cushions of which at least one is releasably affixed to a planar surface one on each side of an infant to prevent the infant from rolling while sleeping.

BACKGROUND OF THE INVENTION

Infant safety while sleeping has always been a concern for parents. The occurrence of Sudden Infant Death Syndrome (SIDS) has heightened that concern. At present, the cause of SIDS is unknown. It has been theorized that SIDS may be due to infants suffocating by rotating or rolling face down on a mattress or into an obstacle which blocks their breathing, and then not having enough strength to raise their heads or move away from the obstacle.

A support pillow is described in U.S. Pat. No. 5,193,238 by Clute. The support pillow comprises two elongated right triangular members which have thin sheeting material extending from and beyond one lateral edge of each elongated triangular member with mating hook and loop fastening strips on the sheeting material to attach the elongated triangular members together. The vertical walls of the elongated triangular members oppose each other defining a channel. The infant lies lengthwise on its side in the channel on top of the sheeting material. Another fastening strip joins the triangular members above the infant and secures the infant in place. The infant's head projects out one end of the channel and its legs project out the other end of the channel. This ensures that the infant's breathing is not hampered since the infant's face cannot be pressed against a vertical sidewall.

Another embodiment of support pillow is disclosed in U.S. Pat. No. 5,216,772 by Clute in which an elongated recess is formed lengthwise in each vertical sidewall of the support pillow shown in the above-mentioned U.S. Pat. No. 5,193,238 with excluding means to prevent a child's face from entering the recess.

Patent Cooperation Treaty Application No. PCT/CA90/00145 (WO91/16842) discloses a restrainer for maintaining an infant on its side. One weighted chock member normally is placed on a mattress against the back of the infant and a second weighted chock member is placed on the mattress against the infant's chest and stomach. The chock members are joined to each other by a band of quilted fabric which wraps around the infant.

The above patents relate to complex infant support pillow structures which require the joining together of pillows by fastening strips for interaction of the two support pillows to prevent movement of an infant.

SUMMARY OF THE INVENTION

The disadvantages of the prior art may be overcome by providing a relatively simple restrainer device which does not require connector straps for the joining together of the two support pillows which can be readily positioned as desired to restrict an infant's movement.

In its broad aspect, the restrainer of the present invention for limiting human body movement on a planar surface comprises two support cushions of open-cell foam in a spaced-apart relationship to each other on the planar surface, and means for releasably attaching at least one of the support cushions to said planar surface.

According to a preferred aspect of the invention, the support cushions are elongated with a planar base, the planar surface is a sheet or panel of pliable fabric, such as a brushed nylon, and the means for releasably attaching the support pillows to the planar surface is formed on the planar base and the planar surface and comprises at least one strip of elongated hook fasteners on the planar base engageable with mating loop fasteners formed on the planar surface. It is further desirable to envelop each cushion in a thin, permeable fabric enclosure and to provide apertures extending through the support pillow to allow enhanced air flow to an infant supported by the support cushions.

BRIEF DESCRIPTION OF THE DRAWINGS

The present invention will now be described with reference to the accompanying drawings, in which.

DETAILED DESCRIPTION OF THE PREFERRED EMBODIMENT

Figure 3:
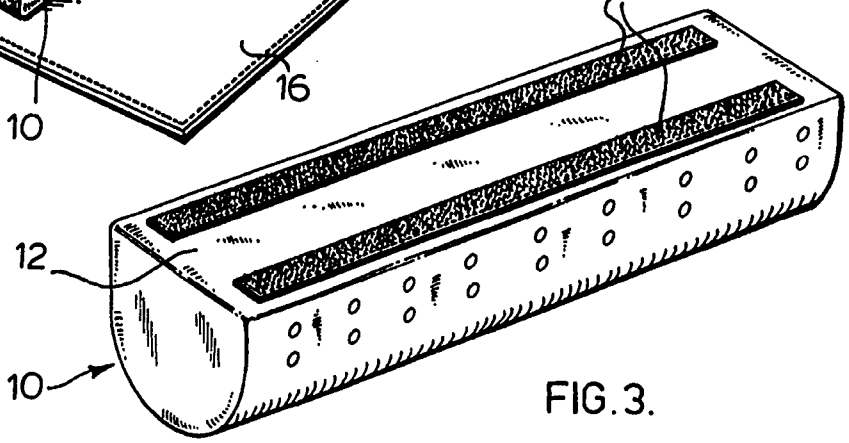
FIG. 3 is a perspective view of the underside of a support cushion.
Figure 2:
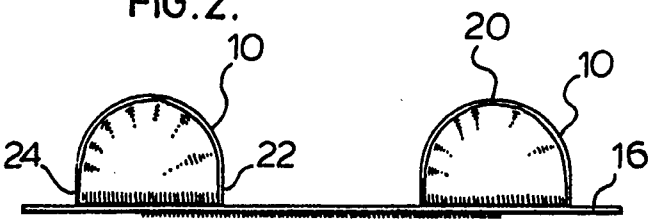
FIG. 2 is an end view of the device of the invention with support cushions as shown in FIG. 1.
Figure 4:
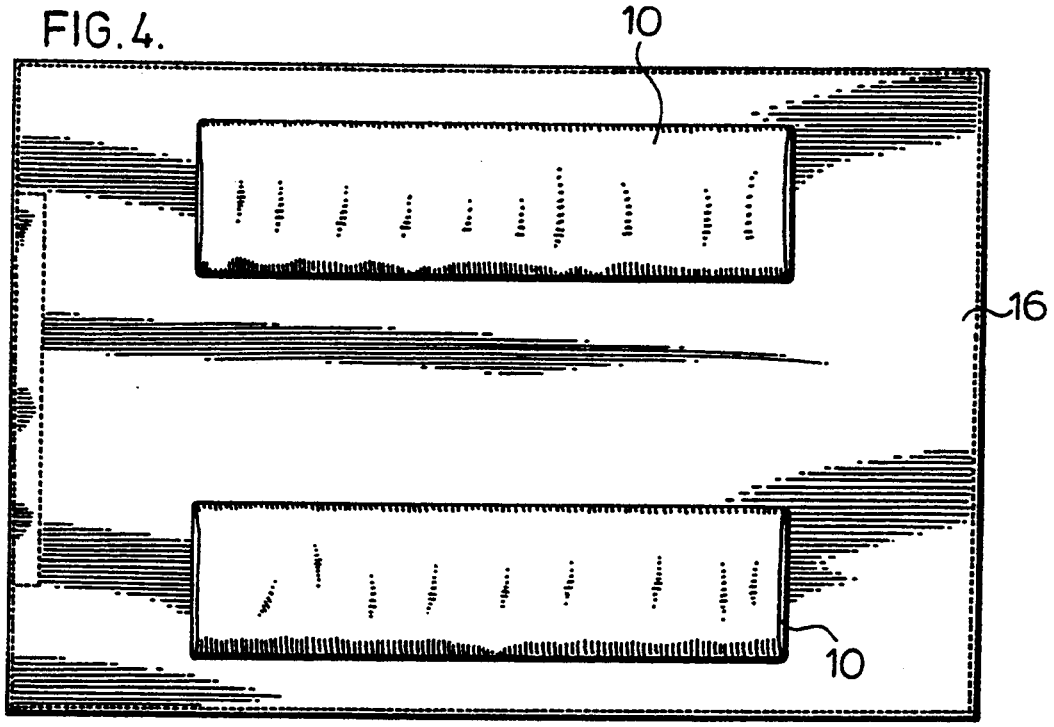
FIG. 4 is a top plan view of the support cushions typified in FIG. 1.
Figure 5:
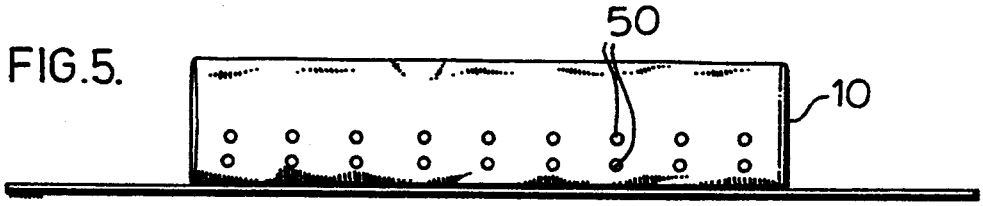
FIG. 5 is a side view thereof.

Referring to FIGS. 1–5 of the drawings, each of elongated support cushions 10 having a planar base 12 is releasably attached to upwardly facing loop fasteners 14 formed on planar surface 16, such as provided by brushed nylon fabric, by at least one strip of downwardly facing elongated hook fastens 18, such as VELCRO TM hook fasteners, attached to the planar base 12. Hook fasteners 18, can be used to enable support cushions 10 to be releasably attached to planar surface 16 in desired arrangements, such as typified in FIGS. 1 and 7. FIG. 3 shows a pair of spaced-apart elongated hook fastener strips 18 secured longitudinally in proximity to opposite side edges of the planar base 12, but it will be understood that hook fastener strips 16 can be disposed transversely on base 12.

Elongated support cushions 10 preferably are made of resilient, open-cell foam rubber with a removable, thin, permeable fabric enclosure 19 enveloping each cushion foam rubber insert. Enclosure 19 may be opened at one end or opened along its base 12 to allow insertion of the foam rubber insert. The combination of open-cell foam and permeable fabric enclosure allows air to flow through the cushions.

Figure 8:
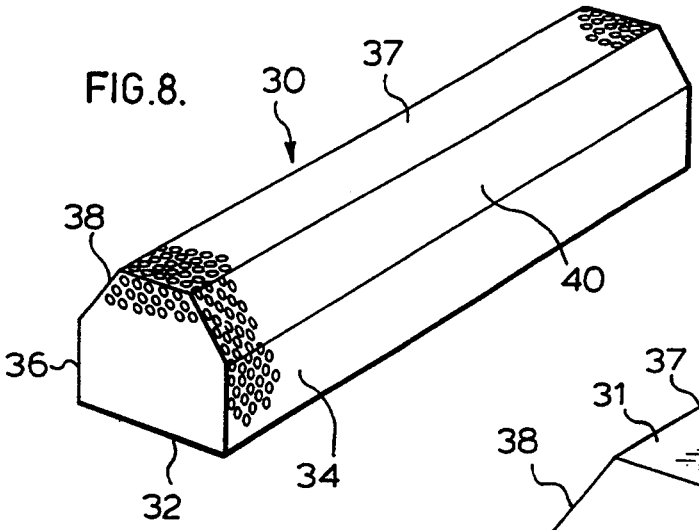
FIG. 8 is a perspective view of a preferred embodiment of foam rubber cushion insert.
Figure 9:
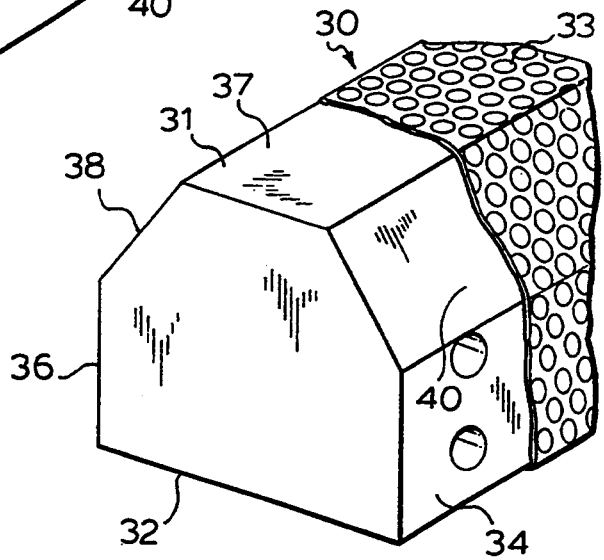
FIG. 9 is a fragmentary perspective view, partly cut away, of a foam rubber cushion with fabric enclosure.

The embodiment of elongated cushion shown in FIGS. 1–5 has a planar, i.e. flat, base 12 with a generally cylindrical or arcuate upper surface 20 with opposite upstanding lower sidewalls 22, 24 substantially perpendicular to the plane of base 12. With reference now to FIG. 8 and 9, the embodiment of elongated cushion 30 illustrated therein has a planar base 32, upstanding opposite lower side walls 34, 36 substantially perpendicular to the plane of base 32, a flat upper surface 37, and longitudinal bevelled upper corners 38, 40. The bevelled longitudinal upper corners 38, 40 of cushion 30 impart a generally arcuate shape to the upper portions thereof. Cushion 30 comprises resilient, open-cell rubber insert 31 with removable, thin, permeable fabric enclosure 33 which can be opened at an end or at the bottom for removal of insert 31.

Figure 10:
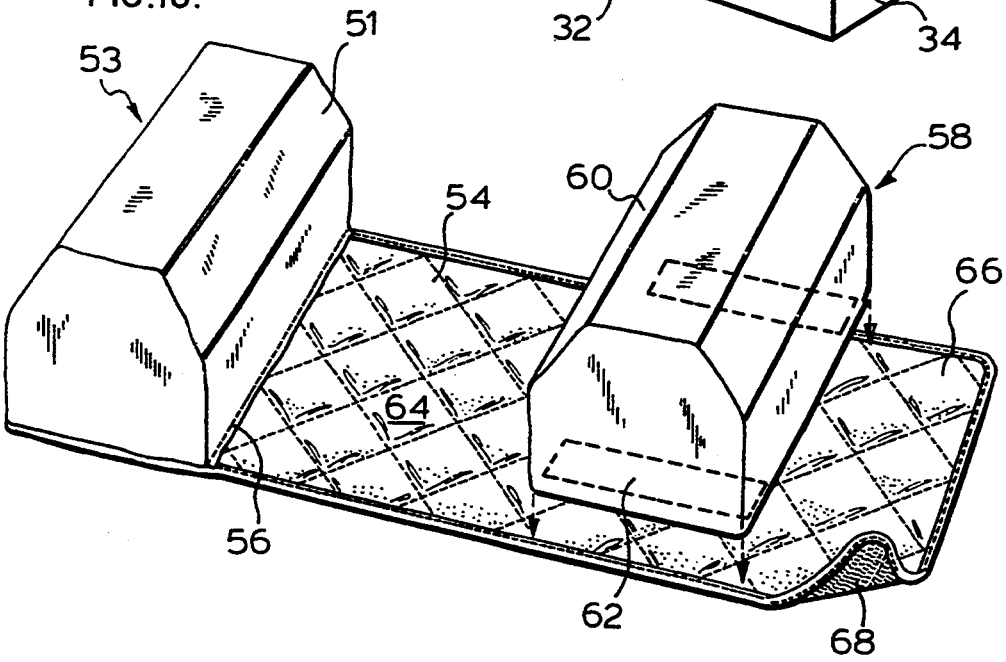
FIG. 10 is a perspective view of a still further embodiment of the invention.

Planar surface 16 preferably is composed of a sheet or panel of a pliable fabric such as nylon fabric (tricot) and is formed in a rectangular, circular, elliptical or the like shape having the loop fasteners 14 formed thereon to which the hook fasteners 18 will releasably attach. The loop fasteners are formed by brushing of the nylon fabric to develop the loops over the full surface of planar surface 16. A soft and aesthetic planar surface 16 can be provided by quilting a pair of co-extensive sheets of nylon fabric, as shown in FIG. 10, to be described, and brushing one side of the quilt to develop the loop fasteners.

Planar surface 16 may also comprise a bed sheet, mattress or the like having loop fasteners formed thereon to which the elongated hook fasteners will releasably engage. Loop fasteners 14 may be formed co-extensive with the planar surface 16 or may be formed in strips attached to the planar surface.

Figure 1:
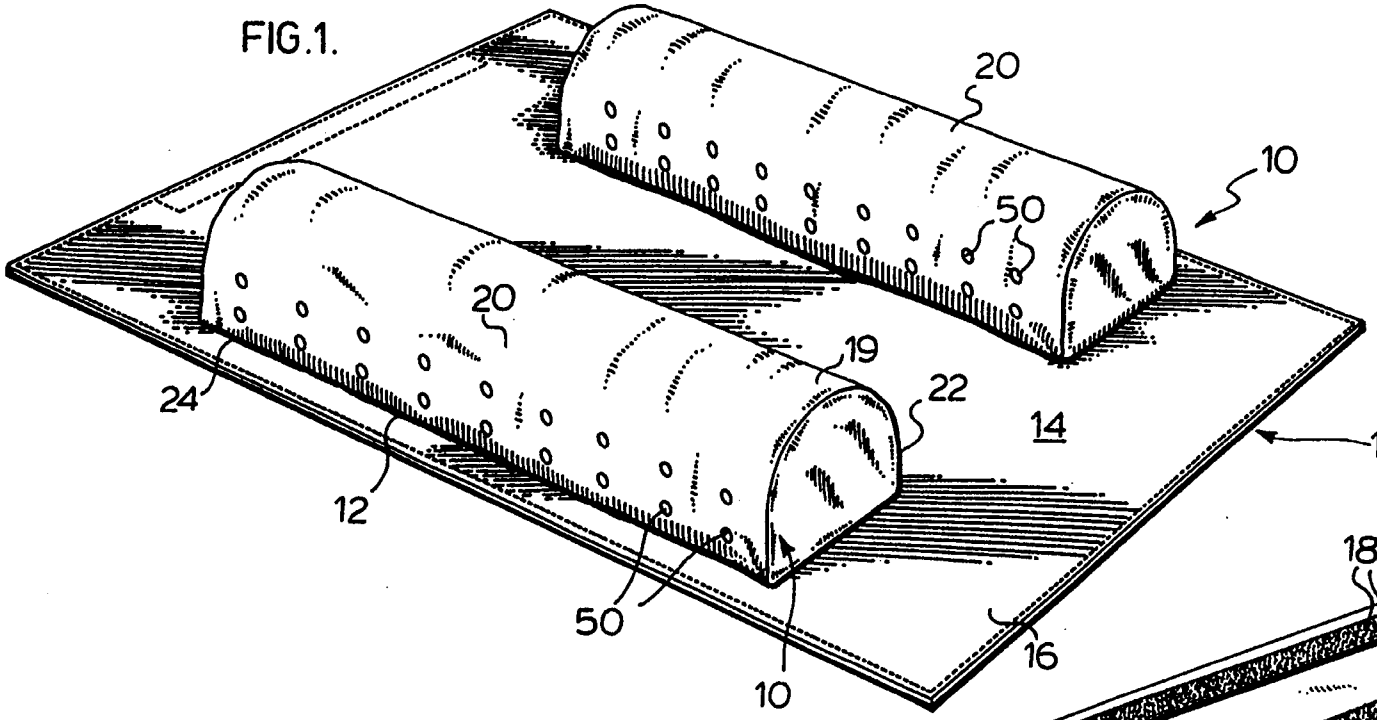
FIG. 1 is a perspective view of an embodiment of the device of the invention showing the support cushions in an operative position releasably affixed to a panel.
Figure 7:
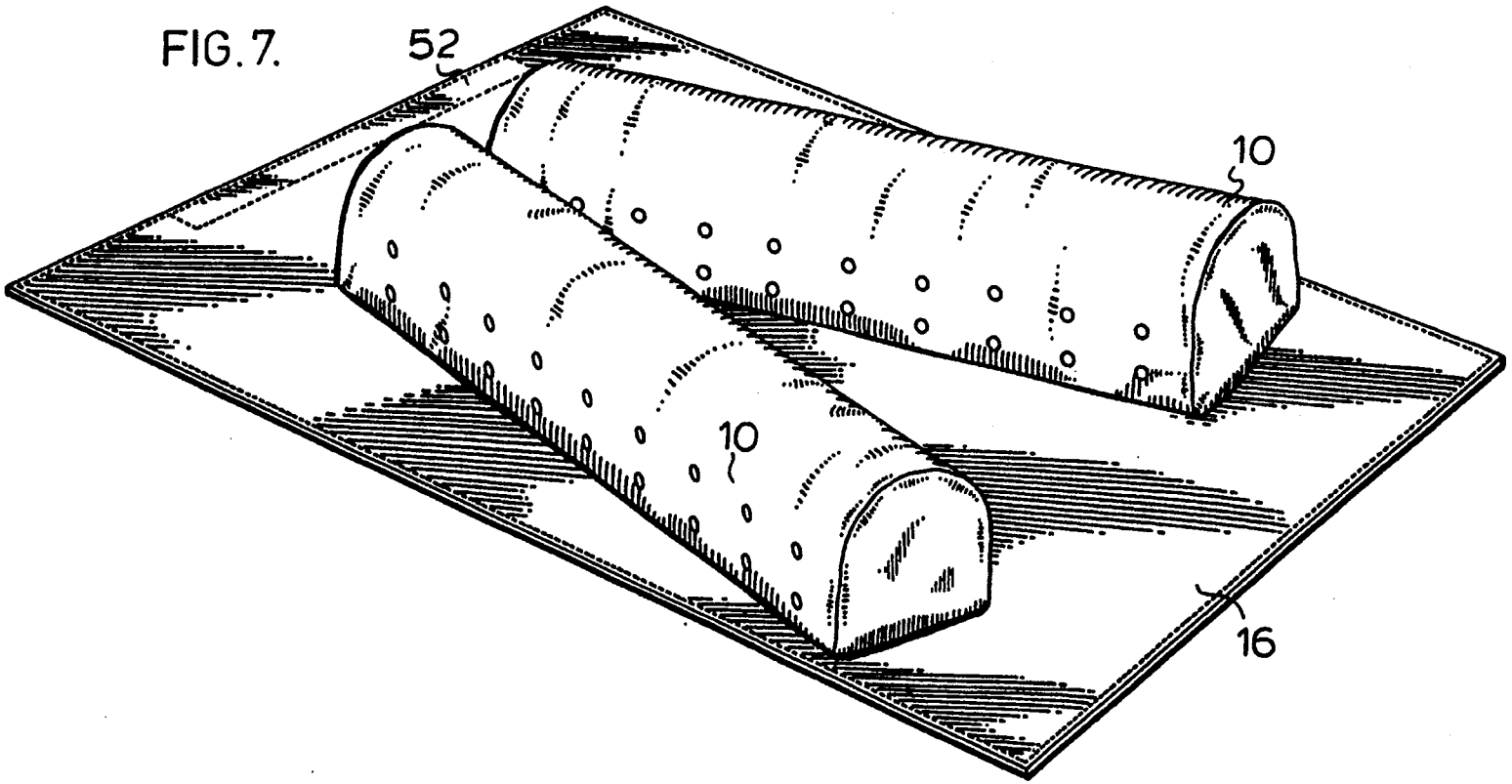
FIG. 7 is a perspective view of another operative position of the invention.

The use of such planar surfaces allows for the placement of a pair of support cushions 10 in various configurations as shown in FIGS. 1 and 7. The pair of spaced-apart support cushions 10 in cooperation with each other, with attachment of the support cushions 10 to planar surface 16, maintains the infant lying between the cushions generally stationary and effectively prevents the infant from rolling over.

In the preferred embodiment, support cushions 10 are arranged as shown in FIG. 1 in which the support cushions 10 are substantially parallel to each other to ensure that the infant's movement is restrained. However, embodiments such as that shown in FIG. 7 are acceptable since the infant will still be able to be restrained while propped in an inclined or seating position.

In the preferred embodiment of the invention, support cushions 10 contain a plurality of equispaced apertures 50 which extend transversely through the support cushions to further facilitate air flow through the support pillows. The light, permeable enclosure 19 enveloping support pillows 10 maintains apertures 50 unblocked.

Figure 6:
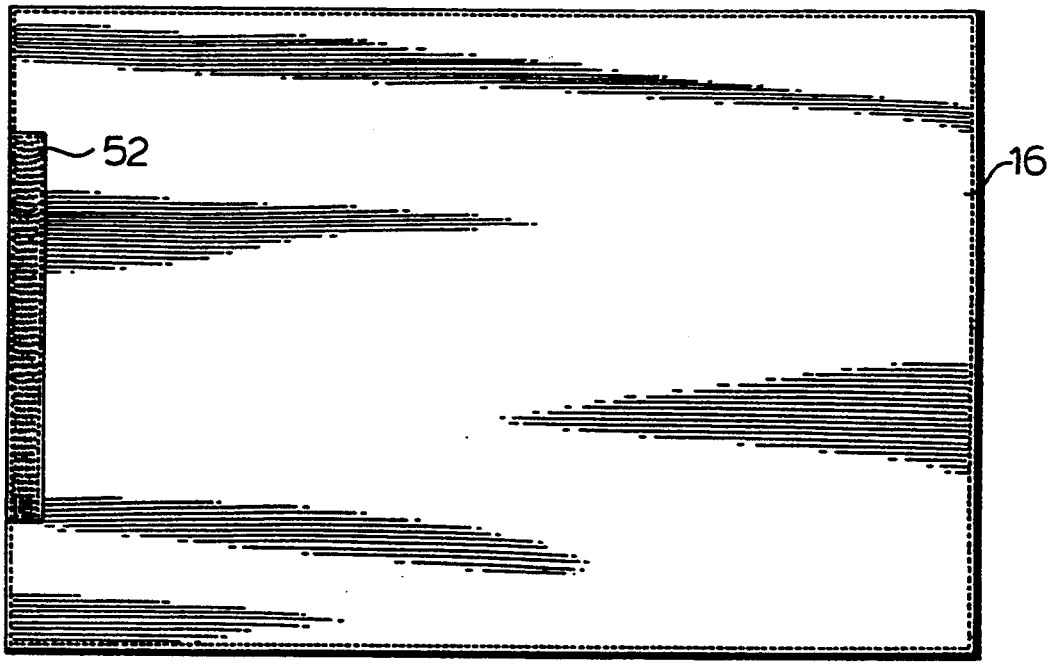
FIG. 6 is a bottom plan view of an embodiment of the panel.

Planar surface 16, such as a rectangular sheet or panel 17 illustrated, may also be releasably attached to an undersurface such as a bed or to a sheet on a bed by a strip 52 of elongated hook fasteners such as VELCRO TM fasteners secured to the underside thereof, as shown in FIG. 6. Strip 52 also conveniently allows panel 17 to be rolled into a bundle enveloping cushions 10, with strip 52 secured to the loops 14 on surface 16.

FIG. 10 shows another embodiment of support cushions in which cushion enclosure 51 of cushion 53 is permanently attached to an end of pliable rectangular panel 54 by stitching 56. Cushion 58 having enclosure 60 to which transverse hook fasteners 62 are attached is removably attached to panel 54 a desired distance from cushion 53 by engagement of hook fasteners 62 to loop fasteners 64 formed on panel 54. Panel 54 preferably is formed of two layers 66, 68 of quilted nylon fabric having loop fasteners formed on the upper side of layer 16 by brushing.

It will be understood that modifications can be made in the embodiment of the invention described here without departing from the scope and purview of the invention as defined by the appended claims.

I claim:

1. A restrainer for limiting an infant's movement comprising, in combination: a planar surface formed of a pair of co-extensive quilted sheets of nylon fabric, one sheet being brushed to form loop fasteners, two elongated support cushions each having a planar base for arrangement in a spaced-apart relationship to each other on said planar surface, and at least one hook fastener strip secured to at least one of said planar bases for releasable attachment of the support cushion to the planar surface.

2. A restrainer as claimed in claim 1 in which at least one hook fastening strip is secured to the opposite underside of the sheet for releasably attaching the sheet to an undersurface.

3. A restrainer as claimed in claim 1 in which the two support cushions are spaced apart a distance substantially equal to the width of an infant to retrain the infant from rolling.

4. A restrainer as claimed in claim 1 in which the support cushions are spaced apart to form a V-configuration.

5. A restrainer as claimed in claim 1 in which both cushions have fastener strips secured to the planar bases for releasable attachment of the support cushions to the planar surface.

6. A restrainer as claimed in claim 5 in which the cushions are formed of an open-cell resilient foam rubber and have a permeable fabric enclosure, said hook fastener strip being attached to the enclosure for the foam rubber.

7. A restrainer device as claimed in claim 5 in which said support cushions have a plurality of equispaced apertures extending transversely through the cushions.

* * * * *